US005344508A

United States Patent [19]

Gilman et al.

[11] Patent Number: 5,344,508

[45] Date of Patent: Sep. 6, 1994

[54] FLOW FORMING OF ALUMINUM ALLOY PRODUCTS

[75] Inventors: Paul S. Gilman, Suffern, N.Y.; Anthony Testa, Denville, N.J.

[73] Assignee: AlliedSignal Inc., Morristown Township, Morris County, N.J.

[21] Appl. No.: 134,706

[22] Filed: Oct. 12, 1993

[51] Int. Cl.[5] ..... B22F 5/00; B21D 22/00

[52] U.S. Cl. ..... 148/514; 72/82; 72/214; 72/220; 72/700; 148/689; 148/437

[58] Field of Search ..... 148/514, 689, 437; 420/548, 550, 551; 72/82, 214, 220, 700

[56] References Cited

U.S. PATENT DOCUMENTS 1,666,581 4/1928 Rainaud ..... 72/82
5,154,780 10/1992 PremKumar ..... 148/514

OTHER PUBLICATIONS

"Tube Spinning", Metals Handbook, 9th Edition, vol. 14 (pp. 675 to 679); ASM International (Materials Park, Ohio), 1988.

*Primary Examiner*—Richard O. Dean
*Assistant Examiner*—Robert R. Koehler
*Attorney, Agent, or Firm*—Ernest D. Buff; Roger H. Criss

[57] ABSTRACT

Rapidly solidified aluminum base alloy is flow formed into tubes and tubular components using conventional flow forming equipment. A preform of preselected configuration and wall thickness for either forward or back spinning is fabricated. Flow forming is then carried out. The beginning of the flow forming step is offset by leaving undeformed a small section of the preform.

8 Claims, No Drawings

FLOW FORMING OF ALUMINUM ALLOY PRODUCTS

FIELD OF THE INVENTION

The present invention relates to rapidly solidified aluminum base alloys, and more particularly to a method for flow forming of the rapidly solidified aluminum alloy.

Description of the Prior Art

In recent years the aerospace industry has searched for high temperature aluminum alloys to replace titanium and existing aluminum base alloys in applications requiring operating temperatures approaching 350° C. While high strength at ambient and elevated temperatures is a primary requirement, certain design applications mandate that candidate alloys also exhibit, in combination, ductility, toughness, fatigue and corrosion resistance, as well as lower density than the materials currently being used. In addition to the scientific requirements to be met in developing such alloys, stringent economic requirements must be met in the fabrication of such alloys into useful forms. In many cases, potential savings gained by direct alloy substitution are offset by the complexity and magnitude of forming operations necessary for fabricating desired shapes. It would be particularly advantageous if a high temperature aluminum base alloy could be easily formed into a tube with existing equipment, thereby eliminating the additional expenses associated with retooling or redesigning equipment for fabrication.

For any forming process to be successful, parts fabricated therefrom must demonstrate mechanical properties which are reproducible. The mechanical properties must be attainable under a practical range of forming conditions and are substantially affected by fabrication parameters.

To date, the majority of aluminum base alloys being considered for elevated temperature applications are produced by rapid solidification. Such processes typically produce homogeneous materials, and permit control of chemical composition by providing for incorporation of strengthening dispersoids into the alloy at sizes and volume fractions unattainable by conventional ingot metallurgy. Chemical compositions of aluminum base alloys for elevated temperature applications and processes for producing them have been described in U.S. Pat. No. 2,963,780 to Lyle et al.; U.S. Pat. No. 2,967,351 to Roberts et al.; U.S. Pat. No. 3,462,248 to Roberts et al.; U.S. Pat. No. 4,379,719 to Hildeman et al.; U.S. Pat. No. 4,347,076 to Ray et al.; U.S. Pat. No. 4,647,321 to Adam et al. and U.S. Pat. No. 4,729,790 to Skinner et al . The alloys taught by Lyle et al., Roberts et al. and Hildeman et al. were produced by atomizing liquid metals into finely divided droplets by high velocity gas streams. The droplets were cooled by convective cooling at a rate of approximately 104° C./sec. Alternatively, the alloys taught by Adam et al., Ray et al. and Skinner et al. were produced by ejecting and solidifying a liquid metal stream onto a rapidly moving substrate. The produced ribbon is cooled by conductive cooling at rates in the range of 105° to 107° C./sec. In general, the cooling rates achievable by both atomization and melt spinning greatly reduce the size of intermetallic dispersoids formed during the solidification. Furthermore, engineering alloys containing substantially higher quantities of transition elements are able to be produced by rapid solidification with mechanical properties superior to those previously produced by conventional solidification processes.

U.S. Pat. No. 4,869,751 to Zedalis et al. describes a method for forming rapidly solidified, dispersion strengthened, non-heat treatable aluminum base alloys into useful shapes such as sheet, plate extrusions and forgings while retaining the attractive properties achieved through rapid solidification.

The mechanical properties and low densities of the dispersion strengthened aluminum alloys make them very attractive for many aerospace applications requiring tubular forms. Examples include thin wall tubes for use in aerospace environmental control systems and ducting; and thick wall tubes for missile body sections. Most aircraft ducting is presently seamed welded titanium or stainless steel. Because of the difficulty of welding the rapidly solidified aluminum alloys a technique that forms seamless tubes was desired such as flow forming or tube spinning.

Flow forming or tube spinning is a rotary-point method of extruding metal. Tube spinning follows a purely volumetric rule, depending on the practical limits of the deformation that the metal can withstand. Two distinctly different method or techniques are used for tube spinning, namely backward and forward spinning. In backward spinning the workpiece is held against a fixture on the headstock, the roller advances toward the fixed end of the work piece, and the metal flows in the opposite direction. The two advantages of backward spinning are that the preform, tubular shape prior to spinning, is simpler because it slides over the mandrel and does not require an internal flange for clamping; and the roller transverses only a fraction of the total length of the desired piece in making a long part. The major disadvantage of backward spinning is that the first portion of the spun tube must travel the greatest distance and is therefore subjected to distortion. In forward spinning the roller moves away from the fixed end of the workpiece, and the work metal flows in the same direction as the roller. The main advantage of forward spinning is that it overcomes the problem of distortion sometimes found in back spinning. The disadvantages of forward spinning are that the preform must be clamped to the mandrel and production is slower because the rollers must traverse the finished length of the workpiece.

Tube spinning should be extremely advantageous to the fabrication of seamless, rapidly solidified aluminum base alloy tubing because the technique allows the formation of thin tubing, down to 5 mm thick walls, with lengths greater than 4 m long, and with excellent surface finish. In addition, flow forming is amenable to formation of tubes having variable wall thicknesses. In practice however, attempts to tube spin rapidly solidified aluminum alloys have produced poor results. Especially in cases where the alloy appointed to be tube spun has low ductility or low fracture toughness, or is notch sensitive. When subjected to forward or backward spinning, such rapidly solidified aluminum alloys tend to crack immediately after the application of the spinning rolls. These cracks are parallel to the mandrel and run in from the end of the preform where the rollers were first applied.

The need remains in the art for a process for flow forming rapidly solidified aluminum alloys into useful tubular products.

SUMMARY OF THE INVENTION

The present invention provides an economical, efficient process for flow forming a rapidly solidified aluminum base alloy preform into a useful tube or tubular component. The process is especially suited for flow forming seamless tubular components having thin walls for example for aircraft ducting or variable wall thicknesses for complex tubular components such as missile body sections. The formation of cracks in the flow formed components is essentially eliminated.

The preforms used for flow forming are typically extruded products. Preforms can be fabricated from solid extruded bars, direct extruded pipe, or back extruded forgings that are machined to the desired internal and external diameters. The specific configurations of the preforms are those typically chosen by one skilled in the art. Flow forming is performed on standard two or three roller flow forming or tube spinning machines existing throughout the metalworking industry. Moreover, selection of processing steps capable of being performed on existing equipment greatly improves economy of material usage, labor and time. Advantageously, in accordance with the present invention, rapidly solidified aluminum base alloys are flow formed in an economical, efficient manner, and the useful mechanical properties are retained.

The present invention provides a process for flow forming a rapidly solidified aluminum base alloy consisting essentially of the formula $Al_{bal}Fe_aSi_bX_c$, where X is at least one element selected from the group consisting of Mn, V, Cr, Mo, W, Nb, Ta, "a" ranges from 2.0 to 7.5 atomic %, "b" ranges from 0.5 to 3.0 atomic %, "c" ranges from 0.05 to 3.5 atomic % and the balance is aluminum plus incidental impurities, the process comprising the steps of:

a. preparing a preform of preselected configuration and wall thickness for either forward or back spinning; and b. offsetting the beginning of flow forming by leaving undeformed a small section of preform having a minimum length of 3 nun..

With this procedure, reductions up to approximately 75% per pass can be accomplished with total reductions up to approximately 90% being achievable. Leaving the undeformed end of the preform by offsetting the beginning of flow forming by a minimum length of 3mm acts to constrain the end of the product, eliminating the propensity of the part to crack once the roll moves away.

In general, the products produced by the process of the invention maintain excellent mechanical properties, including high strength and ductility at ambient as well as elevated temperatures. Advantageously, the products produced by the process of the invention are substantially defect free. That is to say, the flow formed products exhibit little or no defects such as cracking in the work length.

Alloys preferred for use in the process of this invention include those rapidly solidified aluminum alloys which consist essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at%, "b" ranges from 0.5 to 3.0 at%, "c" ranges from 0.05 to 3.5 at% and the balance is aluminum plus incidental impurities, with the proviso that the ratio {Fe+X}:Si ranges from about 2.0:1 to 5.0:1.

The flow forming of the rapidly solidified aluminum alloys overcome problems of property degradation that were heretofore present during hot deformation. Retention of the attractive properties achieved by rapid solidification becomes paramount with the result that hot deformation procedures are eliminated. The attractive properties achieved by rapid solidification are essentially not affected by flow forming.

DESCRIPTION OF THE PREFERRED EMBODIMENTS

The present invention provides a process for producing flow formed tubes or tubular components composed of a rapidly solidified aluminum base alloy by preparing a preform of the desired configuration and wall thickness for either forward or back spinning; and offsetting the beginning of flow forming by leaving a small section of the preform undeformed.

In one aspect, the preform is made from a direct extrude pipe extruded to an extrusion ratio greater than approximately 4 to 1. The extrusion ratio is the ratio of the initial cross sectional area of the billet measured prior to extrusion, to the cross sectional area of the extrudate.

In another aspect, the preform is machined from a solid extruded bar extruded to an extrusion ratio greater than approximately 8 to 1.

In yet another aspect, the preform is fabricated from a back extruded or forged tube, extruded or forged to a ratio greater than approximately 4 to 1.

In a preferred embodiment, alloys of the present invention are rapidly solidified aluminum alloys, which consist essentially of the formula $Al_{bal}Fe_aSi_bX_c$, wherein X is at least one element selected from the group consisting of Mn, V, Cr, Mo, W, Nb, Ta, "a" ranges from 2.0 to 7.5 at%, "b" ranges from 0.5 to 3.0 at%, "c" ranges from 0.05 to 3.5 at% and the balance is aluminum plus incidental impurities.

To provide the desired levels of strength, toughness and ductility needed for commercially useful applications, the alloys of the invention are rapidly solidified at cooling rates sufficient to greatly reduce the size of the intermetallic dispersoids formed during the solidification as well as allow for substantially higher quantities of transition elements to be added than possible by conventional solidification processes. The rapid solidification process is one wherein the alloy is placed into a molten state and then cooled at a quench rate of at least about $10^5$ to $10^{7°}$ C./sec to form a solid substance. Preferably, this method should cool the molten metal at a rate of greater than about $10^{6°}$ C./sec, i.e., via melt spinning, splat cooling or planar flow casting, which forms a solid ribbon. These alloys have an as-cast microstructure which varies from a microeutectic to a microcellular structure, depending on the specific alloy chemistry. In the present invention, the relative proportions of these structures are not critical.

Ribbons of these alloys are formed into particles by conventional comminution devices such as pulverizers, knife mills, rotating hammer mills and the like. Preferably, the comminuted powder particles have a size ranging from about −40 mesh to about −200 mesh, U.S. standard sieve size.

The particles may then be canless vacuum hot pressed at a temperature ranging from about 275° C. to 550° C., preferably ranging from about 300° C. to 500° C., in a vacuum less than $10^{-4}$ torr ($1.33\times10^{-2}$ Pa), preferably less than $10^{-5}$ torr ($1.33\times10^{-3}$ Pa), and then compacted in a blind die. Those skilled in the art will appreciate that compaction may also be performed by placing the comminuted powder in metal cans, such as aluminum cans having a diameter as large as 30 cm or more, hot degassed in the can under the aforementioned conditions, sealed therein under vacuum, and thereafter re-heated within the can and compacted to full density, the compacting step being conducted, for example, in a blind die extrusion press. In general, any technique applicable to the art of powder metallurgy which does not involve liquefying (melting) or partially liquefying (sintering) the matrix metal can be used.

The resultant billets comprise an extruded product, of either solid or tubular cross sections, wherein the billet, compacted to sufficient density for forming into an extrusion of substantially full density, is then extruded at a stock temperature ranging from the incipient extruding temperature to about 500° C.

In another aspect, the resultant compacts comprise a forged product wherein a billet, compacted as before to sufficient density to be formed into a forging of substantially full density, is then forged at a stock temperature ranging from the incipient forging temperature to about 500° C.

Contrary to conventional practice, wherein aluminum alloys are annealed to a softened state before the forming operation is commenced, the present invention provides a method for cold forming rapidly solidified dispersion strengthened aluminum base alloys wherein forming is initiated without subjecting the alloy to heat treatment.

The following examples are presented to provide a more complete understanding of the invention. The specifice techniques, conditions, materials, proportions and reported data set forth to illustrate the principles and practice of the invention are exemplary and shall not be construed as limiting the scope of the invention.

EXAMPLE I

One 254 nun diameter billet of the nominal composition 4.33 atomic % iron, 0.73 atomic % vanadium, 1.72 atomic % silicon and the balance aluminum( hereinafter designated alloy 8009) was direct extruded at approximately 400° C. to a nominally 84 mm diameter solid bar, and extrusion ratio of approximately 9 to 1. The extruded bar was machined into a flow forming preform of the following dimensions: 79 mm outside diameter, 49 nun inside diameter and 102 mm long. The preform was backward flow formed on a three roller machine. The first pass was set for a 50% reduction. However, once the rollers moved past the initiation of the flow forming, the end of the preform cracked. The cracks were longitudinal and ran from the initial flow formed end of the preform.

EXAMPLE II

Flow forming preforms were prepared as per Example I. The preform was backward flow formed on a three roller machine. The first pass was set for a 50% reduction. However, the initiation of flow forming was offset approximately 6 nun from the end of the preform and the first reduction was approximately 50%. Following the same procedure an additional 50% reduction and 75% reduction were applied to the preform with no observable cracking. The final wall thickness of the flow formed tube was approximately 0.89 mm.

EXAMPLE III

Several 235 nun outside diameter by 92 nun inside diameter billets of the nominal composition 2.73 atomic % iron, 0.27 atomic % vanadium, 1.05 atomic % silicon and the balance aluminum (hereinafter designated alloy 8022) were direct extruded at approximately 400° C. to a nominally 117 nun outside diameter by 92 mm inside diameter tube, an extrusion ratio of approximately 9 to 1. From the tubular extrusions, flow forming preforms of the following dimensions were machined: 105 nun outside diameter, 100 nun inside diameter and 355.6 nun long. The preform was backward flow formed on a three roller machine. When the flow forming was initiated at the end of the preform, the work piece cracked. Cracking was avoided by offsetting the initiation of the flow forming by approximately 6 mm from the end of the preform.

Having thus described the invention in rather full detail, it will be apparent that such detail need not be strictly adhered to but that various changes and modifications may suggest themselves to one skilled in the art, all falling within the scope of the invention as defined by the subjoined claims.

We claim:

1. A process for flow forming a rapidly solidified aluminum base alloy consisting essentially of the formula $Al_{bal}Fe_aSi_bX_c$, where X is at least one element selected from the group consisting of Mn, V, Cr, Mo, W, Nb, Ta, "a" ranges from 2.0 to 7.5 atomic %, "b" ranges from 0.5 to 3.0 atomic %, "c" ranges from 0.05 to 3.5 atomic % and the balance is aluminum plus incidental impurities, the process comprising the steps of:

a. preparing a preform of preselected configuration and wall thickness for either forward or back spinning; and b. offsetting the beginning of flow forming by leaving undeformed a small section of said preform.

2. A process as recited by claim 1, wherein said offset of the initiation of flow forming is at least 3 mm from initiation end of the preform.

3. A flow formed product composed of a rapidly solidified aluminum base alloy and having been formed by the process of claim 1.

4. A process as recited by claim 1, wherein said flow forming preform is fabricated from an extruded bar, said bar being extruded using an extrusion ratio of at least 8 to 1.

5. A process as recited by claim 1, wherein said flow forming preform is fabricated from a direct extruded tube, said tube being extruded using an extrusion ratio of at least 4 to 1.

6. A process as recited by claim 1, wherein said flow forming preform is fabricated from a back extruded or forged tube, said tube being fabricated using an area reduction ratio of at least 4 to 1.

7. A process recited by claim 1 wherein said aluminum base alloy has a composition consisting essentially of 4.33 atomic % iron, 0.73 atomic % vanadium, 1,72 atomic % silicon and the balance being aluminum.

8. A process recited by claim 1 wherein said aluminum base alloy has a composition consisting essentially of 2.73 atomic % iron, 0..27 atomic % vanadium, 1.05 atomic % silicon and the balance being aluminum.

* * * * *